United States Patent [19]

Riba

[11] Patent Number: 4,881,493

[45] Date of Patent: Nov. 21, 1989

[54] STEAM GENERATOR

[76] Inventor: Günther Riba, Rosenbergstr. 26, D-5455 Hardert, Fed. Rep. of Germany

[21] Appl. No.: 127,899

[22] PCT Filed: Mar. 10, 1987

[86] PCT No.: PCT/EP87/00138

§ 371 Date: Oct. 27, 1987

§ 102(e) Date: Oct. 27, 1987

[87] PCT Pub. No.: WO87/05681

PCT Pub. Date: Sep. 24, 1987

[51] Int. Cl.[4] ..... F22B 5/00

[52] U.S. Cl. ..... 122/13 A; 219/311

[58] Field of Search ..... 122/4 A, 13 A, 13 R; 219/312, 311; 126/348, 369

[56] References Cited

U.S. PATENT DOCUMENTS 2,785,272 3/1957 Baly ..... 219/38
2,861,169 11/1958 Bowen et al. .
3,419,666 12/1968 Groom .
3,910,498 10/1975 Harrison .
4,480,173 10/1984 Butterfield ..... 219/312
4,598,694 7/1986 Cromer ..... 122/13 R

FOREIGN PATENT DOCUMENTS 0193863 9/1986 European Pat. Off. .
2161480 6/1973 Fed. Rep. of Germany .
3410247 10/1984 Fed. Rep. of Germany .
1089500 3/1955 France .
2186117 1/1974 France .

*Primary Examiner*—Edward G. Favors
*Attorney, Agent, or Firm*—Donald Brown

[57] ABSTRACT

A steam generator with a steam boiler (1) is provided. In order to provide for small volume of the steam generator and for managing with a low water level, the steam boiler (1) is designed as a tubular housing which comprises a heating means disposed at the outside thereof in a lower portion adjacent to the lower casing face, and which further comprises a temperature measuring means for determining the water level.

14 Claims, 2 Drawing Sheets

STEAM GENERATOR

The invention refers to a steam generator with a steam boiler according to the preamble of claim 1. A steam generator of this kind shall in particular be suitable for generating steam for a sauna or as a steam source for a flat-iron to be connected thereto through a conduit.

A steam generator according to the preamble of claim 1 is known from the DE-A-34 10 247. This known steam generator comprises a heating coil within the interior of the container. A lower and an upper water level measuring means are provided in a distance from each other and connected with a control unit. The water supply is controlled such that the water level is above the lower and below the upper water level measuring means. In such steam generators the problem is encountered that the heating becomes furred and the heat transfer is then low. The conventional steam generator has the form of a pot which requires that a comparatively large amount of water must be heated in order to obtain steam. The pot must be decalcified from time to time in known manner.

From the DE-A-32 01 574 an apparatus for generating steam for the treatment of pets and in particular the treatment of pigeon feathers is known. The steam generator comprises a pot which is embedded in an outer insulation. a heating means is provided in this outer insulation in a distance from the inner casing. In this apparatus such a small amount of water is heated that just the small amount of steam which is required for the treatment of pigeon feathers may be withdrawn through an outlet pipe. The interior of the container is connected with the environment through the outlet pipe, i.e. pressureless.

It is the object of the invention to provide an improved steam generator. It shall in particular be made possible to provide a large heating power in a smaller boiler volume or liquid volume, respectively, within the boiler. Moreover, the manufacture of the steam generator shall be simple. The water level shall be easily adjustable. The steam generator should in particular be suitable as a steam source for a sauna.

The object is achieved by a steam generator of the kind described at the outset with the features of claim 1.

Further features and advantages of the invention will stand out from the description of an embodiment with reference to the drawings. In the drawings.

Figure 1:
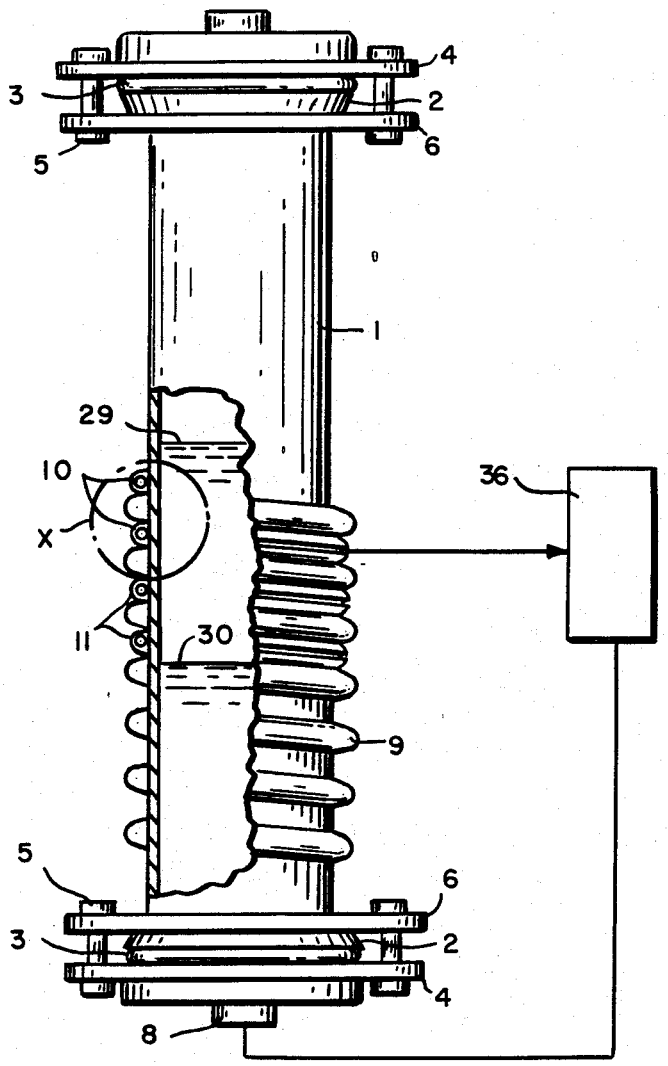
FIG. 1 is a lateral view of the relevant part of the steam generator in partly sectional representation.

The steam generator comprises a steam boiler 1 which is made of stainless special steel and designed in tubular form. Both ends of the tube are provided with a respective flange 2 on which rests a gasket 3. A respective flange cover 4 is pulled together in a dimensionally stable and tight manner with a respective pressure plate 6 by means of bolts 5 at the upper and lower side. An opening 7 for withdrawing steam, which is adapted to be connected with a conduit, is provided at the upper face of the flange cover for. An opening 8 which is connected with a water supply is provided at the lower face of the flange cover for. The lower opening 8 may be opened for the draining-off of boiler sediments or fur.

Figure 4:
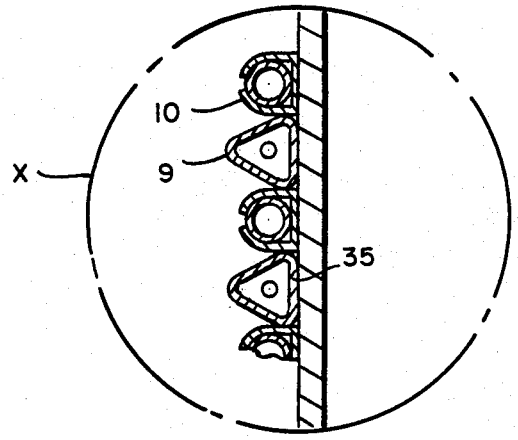
FIG. 4 shows a detail of FIG. 1.

A heating coil 9 is provided in the lower third adjacent to the lower face of the tubular boiler. As may be in particular seen from FIG. 4, the shape of the heating coil 9 is selected to be profiled such that it comprises a large bottom region 35 which all-over contacts the outer side of the boiler shell and is connected thereto in a good heat conducting manner, for example by being metallically alloyed through a sinter brazing process. The boiler 1 thus forms a cooling surface for the heating coil 9. Means for determining the water level within the casing are provided in form of a temperature probe 10 in tight contact with the upper end of the heating coil 9. In the shown embodiment, the temperature probe is formed as a capillary tube sensor and is arranged such that a winding is disposed between the last and last but one winding of the heating coil 9. Furthermore, outwardly adjacent to the last heating coil winding a second temperature probe 11 is provided which is as well designed as a capillary tube sensor.

Figure 2:
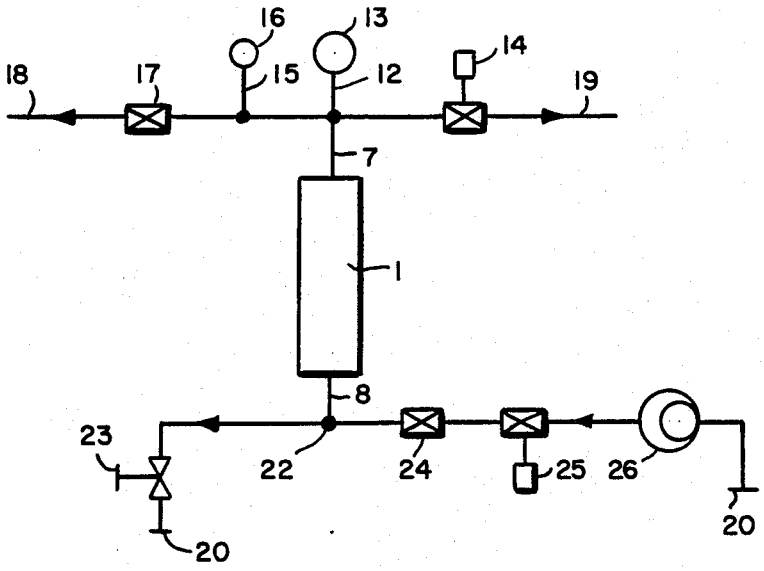
FIG. 2 is a schematic representation of the steam generator with the associated valves.
Figure 3:
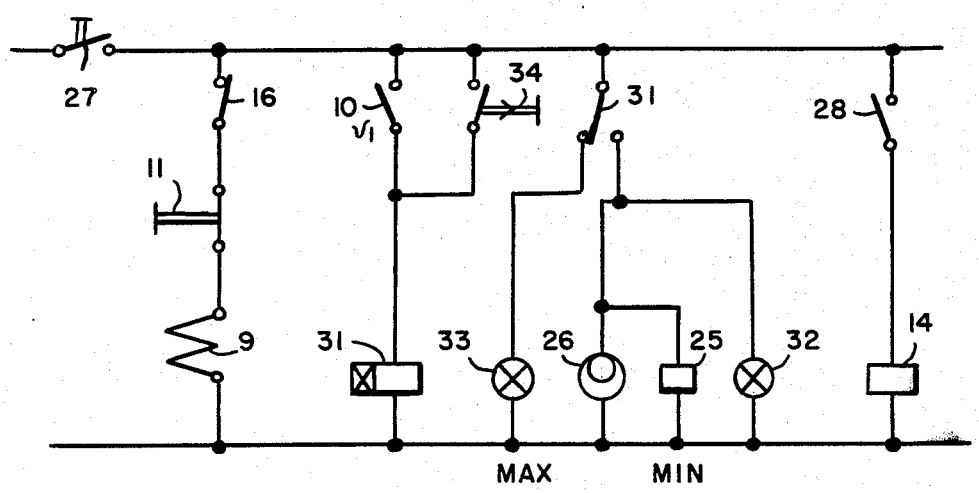
FIG. 3 is a schematic representation of the circuit for operating the steam generator.

As may be seen from FIG. 2, the upper opening 7 is connected with a pressure gauge 13 and a solenoid valve 14 through a cross-piece 12 and with a pressure controller 16 and a safety valve 17 through a T 15. The opening 18 is the outlet of the safety valve 17. The outlet side of the solenoid valve 14 is connected with a conduit 19 for passing the steam to the steam consuming apparatus, the flat-iron or the like. An inlet 20 is connected with the water supply. An outlet 21 forms the fur drain opening.

At the bottom opening 8 an outlet tap 23, a check valve 24 and a solenoid valve 25 disposed at the outlet side thereof are provided through a T 22. A pump 26 is provided at the outlet side between the solenoid valve 25 and the inlet 20.

The operation of the apparatus will be described in the following. By switching on a main switch 27 the heating means formed as heating coil 9 is subjected to a voltage through the pressure controller 16 and the second temperature probe 11 and heats the tubular steam boiler 1 until a temperature is reached which is adjusted at a control unit receiving the outlet signal of the temperature probe 10, whereby the pump is switched on. The entering water strikes the preheated inner boiler surface and fur which is eventually deposited thereon, whereby the fur is forcibly an automatically blasted off. In preheating to a predetermined upper limit value, the control unit 36 limits the temperature at the temperature probe 11 by switching off the heating 9 when this limit value has been reached. The entering water is immediately vaporized and reaches rapidly the operating pressure. The pressure is displayed by the pressure gauge 13. If a switch 28 provided a a flat-iron to be supplied with steam is switched on, the solenoid valve 14 opens and steam is withdrawn. The more steam is withdrawn the faster the water level lowers from a predetermined maximum level 29 to a minimum level 30. As soon as the water approaches the minimum level 30, the heat removal from the upper heating coil is worse, whereby the steam boiler is heated up to a greater extent in this region. The temperature probe 10 is adjusted such that it provides a signal which terminates the water supply as soon as the water level lowers down to the minimum level 30. At this moment a time lag relay 31 is released which responses to the solenoid valve 25 and pump 26. Over a time predetermined by the time lag relay such an amount of water is supplied into the steam boiler that the water level rises from the minimum level 30 to the maximum level 29. The time lag relay 31 simultaneously controls a function of lamps 32, 33 indicating the minimum or maximum, respectively.

The second temperature probe as well serves as a safety switch. The response temperature thereof is adjusted such that it is above the response temperature of the first temperature probe 10, and it is selected such that the second temperature probe 11 switches off the heating in case of failure of the water supply, so that a demolition is prevented.

At the end of an operating phase the apparatus is switched off and the contents of the steam boiler 1 is blown off through the outlet tap 23 in order to drain sediments.

The steam boiler 1 has an inner surface which is formed perfectly smooth and polished, and the heat load per surface is designed to have such a high value that no fur forms at least in the regions of the heating means. Moreover, this fur breaks off, although slowly, during the normal operation except in the first heating phase, and is removed during blow-off so that the decalcification maintenance periods are considerably extended. Heat losses are extremely low due to the galvanic connection between the heating coil and the steam boiler. In addition a not shown outer insulation may be provided by which the heat losses are further reduced. Since it is not necessary to moisten the heating means with water, in contrast to interiorly disposed heating coils, the operation can be performed with an extremely low minimum water level (ca. 0.08 l, 0.13 l at the maximum). The result is an extremely small size. Such a device having an outer diameter of approximately 40 mm and a length of approximately 280 mm is ready for operation in less than a minute, compared with 10–15 minutes for conventional steam generators of comparable power output.

In the above described embodiment the temperature probes are formed as capillary tube sensors. However, other suitable temperature probes such as a PT 100 may be used.

If, as an exception, water is first let into the steam boiler 1 and the heating 9 is put into operation thereafter, the starting process is initiated with the aid of a touch contact switch 34.

An above described device may in a particular suitable manner be used as a steam generator for a steam sauna, since the steam is practically immediately available. In this case the steam boiler is preferably formed pressureless.

Since the contents of the steam boiler is completely blown off through the outlet tap 23 after each switching off of the main switch, a complete cleaning operation is performed automatically. An additional maintenance for decalcification is not longer required.

I claim:

1. A steam generator comprising a vertically-disposed, cylindrical boiler, means connected to the lower end of said boiler to supply water thereto, means connected to the top of said boiler for discharging steam therefrom, control means for supplying water to said means connected to the lower end of said boiler, said control means embodying an inlet and an outlet, means for generating a signal of the water level within said boiler operable to actuate said control means and heating means in the form of a coil of generally triangular cross section disposed about the outer side of the lower portion of said boiler with the broad face of its triangular cross section in all over heat-conductive contact with the outer side of said boiler.

2. A steam generator according to claim 1, wherein said coil is brazed to the outer side of said boiler.

3. A steam generator according to claim 1, wherein said boiler has at its lower end a radial flange.

4. A steam generator according to claim 1, wherein the inner surface of said boiler is formed at least cold-drawn or polished.

5. A steam generator comprising a vertically-disposed, cylindrical boiler, means connected to the lower end of said boiler to supply water thereto, means connected to the top of said boiler for discharging steam therefrom, control means for supplying water to said means connected to the lower end of said boiler, said control means embodying an inlet and an outlet, means in the form of a capillary tube sensor disposed about said boiler for generating a signal of the water level within said boiler operable to actuate said control means, and heating means in the form of a coil disposed on the lower portion about the outer side of said boiler in heat-conductive engagement therewith.

6. A steam generator according to claim 5, wherein said coil is brazed to the outer side of said boiler.

7. A steam generator according to claim 5, wherein the inner surface of said boiler is formed at least cold-drawn or polished.

8. A steam generator comprising a vertically-disposed, cylindrical boiler, means connected to the lower end of said boiler to supply water thereto, means connected to the top of said boiler for discharging steam therefrom, an opening in the lower portion of said boiler for discharging water and draining fur, control means for supplying water to said means connected to the lower end of said boiler, said control means embodying an inlet and an outlet and being formed such that the content of said boiler is discharged through said opening when a main switch is switched off, means for generating a signal of the water level within said boiler operable to actuate said control means, and heating means in the form of a coil disposed on the lower portion about the outer side of said boiler in heat-conductive engagement therewith.

9. A steam generator according to claim 8, wherein said control means is formed such that the water supply remains switched on for a predetermined time after being switched on.

10. A steam generator according to claim 9, wherein said predetermined time is selected such that water enters just up to a predetermined maximum level.

11. A steam generator according to claim 8, wherein the inner surface of said boiler is formed at least cold-drawn or polished.

12. A steam generator according to claim 8, wherein said control means is formed such that, after switching on said main switch, first said heating means is switched on and thereupon the water is supplied into the already heated boiler.

13. A steam generator according to claim 8, wherein said boiler has at its lower end a radial flange.

14. A steam generator according to claim 8, wherein said boiler is designed to be operated in a pressureless manner.

* * * * *